United States Patent [19]

Porth, Jr.

[11] Patent Number: 4,804,048

[45] Date of Patent: Feb. 14, 1989

[54] HAND-HELD TOOL WITH SHAFT LOCK

[75] Inventor: Chris H. Porth, Jr., Bloomingdale, Ill.

[73] Assignee: Skil Corporation, Chicago, Ill.

[21] Appl. No.: 463,998

[22] Filed: Feb. 4, 1983

[51] Int. Cl.[4] ..... B25B 21/00

[52] U.S. Cl. ..... 173/47; 279/1 K; 81/57.22

[58] Field of Search ..... 173/29, 47; 81/57.22, 81/57.23; 279/1 R, 1 K; 74/411.5

[56] References Cited

U.S. PATENT DOCUMENTS

| | | | |
|---|---|---|---|
| 2,575,903 | 11/1951 | Youhouse | 279/52 |
| 2,872,197 | 2/1959 | Happe | 279/1 K |
| 2,979,089 | 4/1961 | Piesker | 81/57.11 |
| 3,021,723 | 2/1962 | Happe | 74/411.5 |
| 3,872,951 | 3/1975 | Hastings Jr. | 279/1 K |
| 3,958,469 | 5/1976 | Meese | 81/58.3 |
| 4,159,050 | 6/1979 | Hopkins, Sr. et al. | 81/58.3 |
| 4,249,435 | 2/1981 | Villeneuve | 81/58.3 |
| 4,323,324 | 4/1982 | Eberhardt | 279/1 K |
| 4,400,995 | 8/1983 | Palm | 188/69 |

*Primary Examiner*—Frank T. Yost
*Assistant Examiner*—James L. Wolfe
*Attorney, Agent, or Firm*—Jones, Day, Reavis & Pogue

[57] ABSTRACT

A hand-held power screwdriver or like tool includes a spindle which is adapted to receive and retain tool bits for rotation thereon. A collet ring is retained with a recess on the housing for slidable movement along the spindle axis. The collet functions as a selectable spindle locking device whereby the tool may be operated as a manual screwdriver or the like by selectively positioning the collet to rigidly lock the spindle in fixed relationship to the tool housing.

6 Claims, 1 Drawing Sheet

FIG. 1
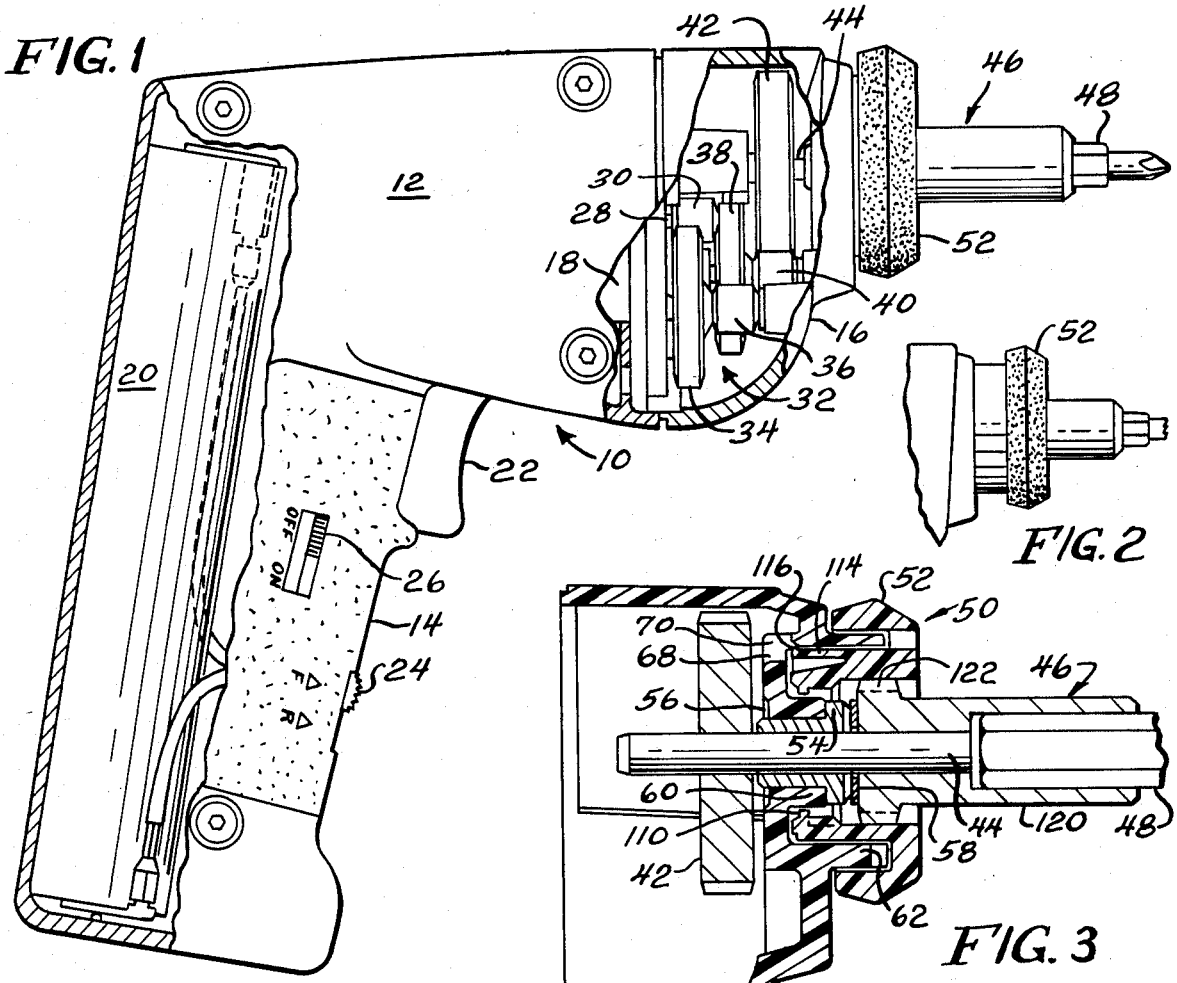
FIG. 2
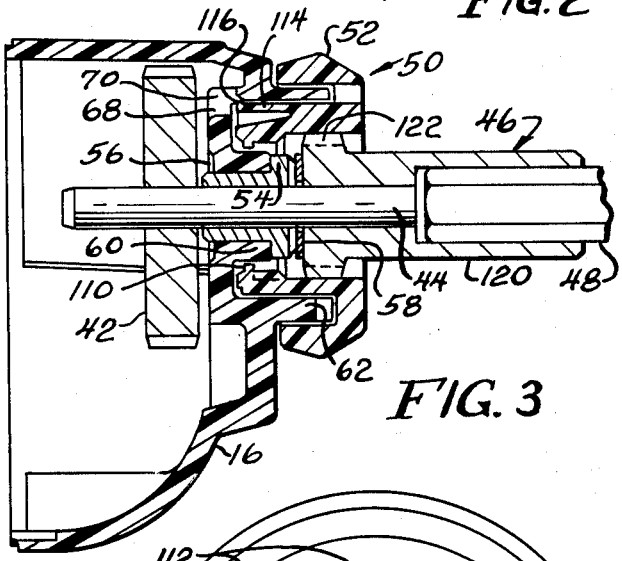
FIG. 3
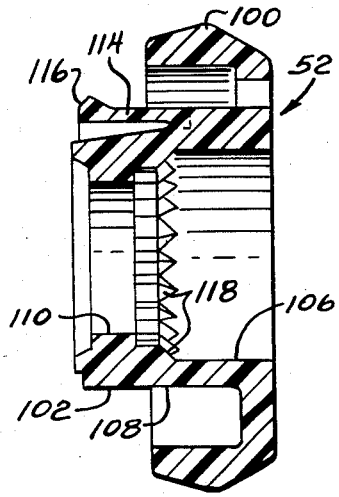
FIG. 4
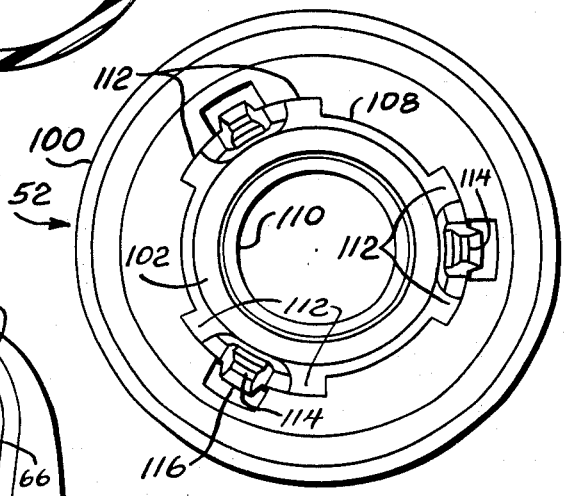
FIG. 5
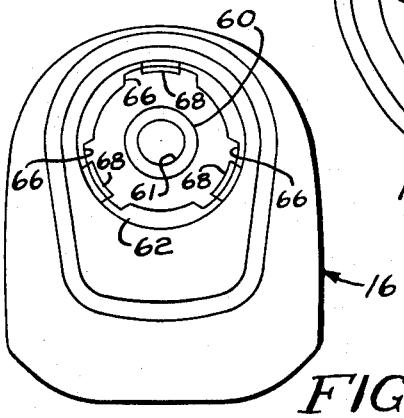
FIG. 6

HAND-HELD TOOL WITH SHAFT LOCK

BACKGROUND OF THE INVENTION

The present invention relates to a hand-held power tool and, more particularly, to a power screwdriver having a user selectable shaft locking arrangement to permit the operation of the tool in a manual non-powered mode whereby greater torque can be delivered to a screw.

It is well known that the torque or force which must be applied to a screw can vary substantially as the screw is advanced into, or removed from, anchoring engagement with the associated surface. In particular, very large forces may be required to ultimately 'set' the screw during installation or to initially 'break loose' the screw during removal. Difficulties have been encountered in generating these large driving forces, particularly in small hand-held tools where size and weight considerations necessarily limit the available motor horsepower. The problem is further aggravated where cordless battery tool operation is contemplated. In such a tool it has been found that batteries of sufficient electrical capacity to power a high-torque cordless screwdriver tool are impractical due to inherent size and weight limitations. This is particularly true with respect to the cordless screwdriver of the instant invention which advantageously features an exceptionally compact, lightweight and completely self-contained construction particularly suited for use in a variety of difficult to access as well as conventional environments.

Proposed solutions to the low torque problem have been found to be objectionable. One such solution provides an increased gear reduction from the motor to the drive bit which correspondingly increasing available torque. This arrangement, however, lowers the drive speed thereby defeating one of the principal advantages of powered operation. Alternatively, a conventional screwdriver may be utilized where necessary to deliver high torque in conjunction with a battery-operated screwdriver of reasonable shaft speed. However, the necessity for frequent switching between these tools renders this solution unattractive.

The compact battery-operated screwdriver of the instant invention advantageously combines, in a single tool, the high speed effortless drive capability of a motor powered screwdriver with the high torque feature of manual screwdrivers often required to set or loosen screws. This combination is achieved by a convenient, user accessible arrangement which rigidly locks the drive shaft and screwdriver bit in fixed relationship to the overall tool housing. In this way, the motor and battery housing serve as a rigid handle for the screwdriver but thereby permitting the manual delivery of substantial torque forces to the screw by the user. It will be appreciated that this arrangement facilitates nearly instantaneous switching between the powered and high torque operating modes without need to withdraw the tool from engagement with the screw or regrasp the tool by the user. The user simply holds the tool by its handle in a conventional manner urging it into engagement with the screw and, as necessary, actuates the locking arrangement of this invention with the other hand.

U.S. Pat. No. 3,789,933 to Jarecki and U.S. Pat. No. 3,809,168 to Fromm, assigned to the present assignee, describe electric power drills having a coupler sleeve arrangement interposed between the drill housing and the bit spindle or chuck. These couplers are adapted to permit the selective operation of the drill in the conventional drill mode, in a hammering mode, or in a combination drill and hammer mode. Neither of these patents teaches means for locking the spindle whereby the power tool may be utilized as a high-torque manual screwdriver.

It is therefore an object of the present invention to provide a compact and lightweight screwdriver tool having conventional power tool shaft speeds generally in excess of those obtainable by manual drive means; the tool may be battery-operated and generally capable of supplying sufficient torque force to advance or remove screws but including a shaft locking arrangement whereby the user may rapidly lock or unlock the shaft in rigid relationship to the housing to facilitate use of the tool either in the powered high speed mode or in a manually operated high torque mode. It is a further object of the invention that the shaft lock arrangement be readily and easily operable and located to permit substantially instantaneous switching between modes by the user while maintaining tool engagement with the screw and normal hand positioning on the tool.

DESCRIPTION OF DRAWINGS

FIG. 1 is a side elevation view of the hand-held screwdriver of the present invention showing the collet spindle lock in the non-locked position and having portions broken away to reveal the battery, motor, and gear reduction assembly;

FIG. 2 is a fragmentary side elevation view showing the collet spindle lock in the locked position;

FIG. 3 is a sectional view of the front housing taken in side elevation showing the spindle and collet in the housing, the collet positioned in the non-locked position;

FIG. 4 is a sectional view of the collet taken along the axis thereof;

FIG. 5 is a rear view of the collet; and

FIG. 6 is a front view of the housing showing the collet receiving recess.

DESCRIPTION OF THE PREFERRED EMBODIMENT

The hand-held screwdriver tool of this invention, shown generally at 10 of FIG. 1, comprises a housing which incorporates a pair of plastic side members 12, mated in opposed relationship to define the tool handle 14, and a plastic front gear housing 16. A compact reversible direct current (DC) motor 18 is secured within housing side members 12 generally adjacent the point of attachment of the gear housing 16.

A source of electrical energy is provided to motor 18 from a nickel-cadmium (Ni-Cad) or similar rechargeable battery 20 located in handle 14. Specifically, the battery and motor are electrically interconnected through trigger switch 22 and forward-reverse switch 24. Trigger switch 22 operates in the customary manner to initiate powered operation of the tool, An on-off button 25, slidably retained within handle 14, is adapted to block movement of the trigger switch button when positioned in the 'off' position. Forward-reverse switch 24 functions to selectively reverse the electrical polarity of the DC battery as connected to the motor thereby selectively reversing the direction of motor rotation. In this manner, the corresponding direction of bit rotation may be chosen to permit the advance or removal of a particular screw as appropriate.

The armature shaft 28 of motor 18, with pinion gear 30 thereon, extends forwardly from the motor into engagement with a three-stage speed reduction assembly 32 in housing 16. Each stage utilizes a relatively small gear located on the first or power source shaft to drivingly engage a relatively larger gear on the second or power receiving shaft thereby effecting, in the well known manner, a speed reduction of the second shaft with respect to the first. Stage one includes the motor pinion gear 30 and a gear 34 rotatably retained on a first intermediate shaft (not visible). The second stage comprises gears 36 and 38 respectively retained for rotation on first and second intermediate shafts (not visible). Finally, the last stage includes gear 40 on the second intermediate shaft and spindle drive gear 42 pressed onto spindle drive shaft 44 which, in turn, is received within spindle 46. Each pair of gears 34, 36 and 38, 40 are rigidly interconnected on respective first and second intermediate shafts to define an integral gear unit for unitary rotation thereon.

The above three stage speed reduction assembly produces approximately a 97 times reduction of shaft speed from the 12,600 rpm motor to about a 130 rpm spindle velocity. Although speed reduction assemblies of the type shown herein are known to produce a corresponding increase in available spindle torque, the compact and lightweight design of motor 18 and battery 20 of the hand-held tool limit the maximum force or torque available to a screwdriver bit 48 retained within spindle 46.

To overcome this limitation of available torque, a spindle locking assembly 50 is provided to rigidly retain spindle 46 in fixed relationship to housing 12, 16. In this manner, the user may utilize the entire tool 10 as a manual screwdriver by grasping handle 14 in the customary fashion and urging the tool into rotation about the spindle axis. Specifically, locking assembly 50 includes an actuator ring or collet 52 adapted for reciprocal movement along the spindle axis between a first 'unlocked' position (as shown in FIGS. 1 and 3) and a second 'locked' position (illustrated in FIG. 2). It will be appreciated that the collet lock of this invention may be readily and repeatedly actuated as necessary with a minimum of lost time or work interruption and generally without the need of removing the tool from engagement with the work piece or screw.

As previously indicated, spindle 46 and drive gear 42 are rigidly secured to shaft 44 for unitary rotation therewith. Referring to FIG. 3, shaft 44 is received for rotation within a bushing 54 which, in turn, is secured within housing 16 by a retention clip 56. A washer 58 forms a bearing between the rotatable spindle 46 and the fixed bushing 54. In normal operation, the tool is urged downwardly onto a screw thereby axially biasing the spindle against washer 58 and bushing 54. During assembly, gear 42 is pressed onto shaft 44 leaving only nominal clearance between gear 42 and bushing 54. In this manner, spindle 46 is constrained against significant axial movement.

The collet lock assembly of the present invention is best shown in FIG. 3 wherein the collet 52 is retained for sliding engagement within housing 16 and is adapted for movement between an unlocked and a locked position, FIGS. 1 and 2, respectively. As described above, the retention of spindle 46 in fixed relationship within bushing 54 and housing 16 permits the free rotation of the spindle with respect to the housing. When positioned in the locked position, however, collet 52 functions as an interface member between the spindle and housing and, specifically, collet 52 is adapted to rigidly engage the spindle and housing thereby locking the spindle against rotation with the housing.

Collet 52, FIGS. 4 and 5, is generally cylindrical in form comprising an outer annular ring 100 and an inner cylindrical body 102. The body 102 of collet 52 functions to retain and guide collet 52 in sliding engagement within the housing 16 and, importantly, body 102 functions as the interface to lock spindle 46 against rotation. The outer annular ring 100 provides a handle enabling the user to grasp the collet when switching the tool between its locked and unlocked modes.

Suitable means are provided on the inner and outer surfaces 106, 108 of the collet body 102 to achieve the desired sliding retention of the collet on housing 16 and to effect the required locking engagement of the collet to the spindle and housing. In particular, an inwardly facing annular ridge 110, on the interior face 106 of collet body 102, is adapted to receive a cylindrical member projecting from housing 16, as outlined below, for sliding engagement thereon. Further, ridge 110 precludes the complete removal of collet 52 by reason of an interference between spindle 46 and collet ridge 110.

As best illustrated in FIG. 5, axial ridge pairs 112 are spaced substantially uniformly around the outside surface 108 of the collet body. As discussed below, mating recesses are provided in housing 16 which facilitate the axial movement of collet 52 within the housing while totally blocking rotational movement therebetween. Ridges 112 remain incontinuous engagement with corresponding housing recesses in both the locked and unlocked collet positions. In this manner, the collet 52 is rigidly retained against rotational movement within housing 16 regardless of the position of the collet or the mode of operation of the screwdriver tool. Fingers or pawls 114, including teeth 116 on the ends thereof, are integrally formed on the outside surface 108 of the collet body between adjacent ridges 112. These pawls are adapted to engage apertures in the housing when the collet is positioned in the unlocked position thereby latching the collet in this position against inadvertent movement.

Spindle engaging teeth 118 are integrally formed on, and extend inwardly from, the inner surface 106 of collet body 102 adjacent ridge 110. Teeth 118 mate with corresponding teeth on spindle 46 when collet 52 is positioned in the forward or locked position thereby rigidly locking spindle 46 against rotation within collet 52.

Spindle 52, as best shown in FIG. 3, includes a shaft portion 120 adapted to retain a screwdriver bits 48 therein and a locking gear portion having annular locking teeth or rack 122. As noted previously, spindle 52, with locking rack 122 thereon, is retained for rotational movement on shaft 44 in fixed relationship to housing 16. Thus, outward sliding movement of collet 52 from the non-locked position to the locked position of FIG. 2 assures the mutual engagement of the spindle locking rack 122 with the collet engaging teeth 118.

Housing 16 includes a collet receiving recess as best shown in FIGS. 3 and 6. This receiving recess provides for the sliding movement of collet 52 along the spindle axis while functioning to totally lock the collet against rotation therein. Specifically, housing 16 includes a generally annular recess, defined between inner and outer cylindrical walls 60 and 62, respectively, adapted to slidably receive the body portion 102 of the collet therein. The inner wall 60 includes a bore 61 therein which, as previously indicated, receives and positions bushing 54 and spindle shaft 44. As shown in FIG. 3, collet body 62 is dimensioned to non-interferingly encircle and reciprocate on wall 60. The outer cylindrical wall 62 closely receives collet body 102 and, therefore, is principally responsible for positioning and guiding the collet for axial sliding movement within housing 16.

Three collet locking recesses 66 are provided within the interior surface of wall 62 to receive axial ridge pairs 112 on the collet body. These recesses extend the full axial length of wall 62 and are spaced around the circumference of wall 62 substantially the same as corresponding collet ridge pairs 112. The width or angle or recesses 66 is selected somewhat larger than the corresponding width or ridge pairs 112 thereby permitting the unrestricted axial movement of the ridges within the wall recesses 66 while blocking substantial rotational movement of the collet therein. Thus, as previously indicated, the engagement of collet ridges 112 with housing recesses 66 locks the collet against rotational movement within the housing without regard to the axial position of the collet.

Pawl receiving apertures 68, each having a sloped or bevelled surface 70, are formed in each recess 66 substantially at the bottom or inward limit thereof. These apertures receive teeth 116 of pawls 114 when the collet is positioned fully in the non-locked position as shown in Figures 1 and 3. In this manner, pawls 114 latch collet 52 against unintentional movement.

In operation, collet 52 is ordinarily positioned in the non-locked position, FIGS. 1 and 3, wherein the collet engaging teeth 118 are retracted from engagement with the locking rack 122 of the fixed mounted spindle. Thus, spindle 46 and bit 48 may freely rotate whenever the user activates the tool trigger switch 22. With the forward-reverse switch 24 in the 'forward' position, for example, a screw may then be driven or advanced into the work piece. On the event that torque forces above the limit of the instant portable tool are encountered, the user, after deactivating switch 22, simply grasps the annular outer ring 100 of collet 52 urging it downwardly toward the work piece into the full locked position of Figure 2. This position is attained where the annular collet ridge 110 is adjacent to or contact the spindle rack 122. It will be appreciated that a modest force must initially be applied to the collet to unseat latching pawls 114 from apertures 68.

In the locked position, collet engaging teeth 118 override the spindle locking rack 122 thereby rigidly locking spindle 46 against rotation within collet 52. Since the collet is similarly restrained against rotational movement in housing 16; the spindle is thereby locked to the housing and to the overall tool.

The user may then utilize the powered screwdriver in its manual mode simply by urging the rotation of the entire tool assembly and bit. Although compact in overall size and weight, the housing of the instant tool serves as an excellent handle means permitting the applications of significant torque forces. The instant tool may readily be returned to its powered mode of operation by repositioning the collet in the original position. It will be appreciated that the collet locking arrangement of this invention is particularly suited for ease of mode switching thereby permitting fast and effortless transitions between the powered and manual modes of tool operation. In this way, the user can efficiently set or remove a substantial quantity of screws without the bother of repeatedly switching from one tool to another.

I claim:

1. In a hand-held power screwdriver or like tool having a housing and a spindle for receipt of tool bits therein, the spindle being retained on a shaft for rotation on the housing, the spindle and shaft defining an axis of rotation; the improvement comprising spindle locking means including:

(a) a collet having a cylindrical body portion and exposed means for grasping the collet, the body having a longitudinal axis and an opening centered on the axis for passage of the spindle and shaft therethrough, said opening defining an inner body surface, axial ridges on the outer surface of the body, spindle engaging means on the inner surface of the body;

(b) a collet recess in the housing, the recess having a substantially cylindrical outer wall surface disposed in symmetric relationship about the axis of rotation and having axial slots in the wall surface, the recess with slots therein being adapted to receive the collet body and ridges for unrestricted axial sliding movement between first locked and second unlocked limits and to block the collet against rotation about its axis with respect to the housing;

(c) a collet body engaging means on the spindle, said means adapted to engage the spindle engaging means on the collet body when the collet is slidably positioned in the first locked limit position thereby rigidly locking the collet and the spindle against relative rotational movement;

whereby the collet may be selectively positioned to alternatively permit the motor driven rotation of the spindle on the housing or to rigidly lock the spindle against rotational movement on the housing thereby permitting operation of the power operated tool in the manual mode in which rotational forces applied to the housing are directly transmitted to the spindle and tool bit therein.

2. The hand-held power tool of claim 1 further characterized in that the tool is self-contained including a battery operatively connected to a motor for driving the spindle.

3. The spindle locking means of claim 2 wherein the axial ridges of the collet body comprises three sets of ridges uniformly spaced about the outer surface of the body; each ridge set including a pair of spaced axial ridges defining an axial space therebetween; and wherein the slots of the collet receiving recess in the housing comprise three uniformly spaced slots, each slot having a width adapted to receive a ridge set.

4. The spindle locking means of claim 1 wherein the axial ridges of the collet body comprise three sets of ridges uniformly spaced about the outer surface of the body; each ridge set including a pair of spaced axial ridges defining an axial space therebetween; and wherein the slots of the collet receiving recess in the housing comprise three uniformly spaced slots, each slot having a width adapted to receive a ridge set.

5. The spindle locking means of claim 4 further including a pawl latching finger disposed within the axial space between each ridge pair and an aperture in each slot of the housing whereby the pawl fingers are received within the apertures when the collet is positioned at the non-locked limit thereby latching the collet against inadvertent movement of the collet.

6. The spindle locking means of claim 5 wherein the collet engaging means on the spindle comprise an annular rack of teeth, said teeth extending radially outwardly and oriented parallel to the spindle axis; and wherein the spindle engaging means on the collet body comprise uniformly spaced teeth around the inner surface of the collet body, said teeth extending radially inwardly therefrom and are oriented parallel to the spindle axis at one end of the inner surface whereby the collet body teeth are adapted to slidably override the spindle rack.

* * * * *